US006523932B2

(12) United States Patent
Johnson

(10) Patent No.: US 6,523,932 B2
(45) Date of Patent: Feb. 25, 2003

(54) PERIODIC EJECTION OF PRINTING FLUID TO SERVICE ORIFICES OF AN INKJET PRINTER

(75) Inventor: Eric Joseph Johnson, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 5 days.

(21) Appl. No.: 09/760,269

(22) Filed: Jan. 14, 2001

(65) Prior Publication Data

US 2002/0093546 A1 Jul. 18, 2002

(51) Int. Cl.[7] ..... B41J 2/165
(52) U.S. Cl. ..... 347/35; 347/23
(58) Field of Search ..... 347/35, 29, 30, 347/31, 32, 36, 22, 23, 14, 19, 24

(56) References Cited

U.S. PATENT DOCUMENTS

| | | | | | |
|---|---|---|---|---|---|
| 4,829,324 | A | | 5/1989 | Drake et al. | 347/63 |
| 5,040,000 | A | * | 8/1991 | Yokoi | 347/29 |
| 5,065,170 | A | | 11/1991 | Rezanka et al. | 347/42 |
| 5,121,130 | A | | 6/1992 | Hempel et al. | 347/95 |
| 5,329,306 | A | | 7/1994 | Carlotta | 347/90 |
| 5,367,326 | A | | 11/1994 | Pond et al. | 347/22 |
| 5,398,053 | A | | 3/1995 | Hirosawa et al. | 347/13 |
| 5,606,353 | A | * | 2/1997 | Mochizuki et al. | 347/23 |
| 5,650,811 | A | | 7/1997 | Seccombe et al. | 347/85 |
| 5,659,342 | A | * | 8/1997 | Lund et al. | 347/35 |
| 5,680,162 | A | | 10/1997 | Taylor et al. | 347/35 |
| 5,694,157 | A | | 12/1997 | Ahlvin | 347/24 |
| 5,838,343 | A | | 11/1998 | Chapin et al. | 347/22 |
| 5,903,288 | A | | 5/1999 | Yamaguchi | 347/24 |
| 5,988,787 | A | | 11/1999 | Watanabe et al. | 347/22 |
| 6,154,231 | A | | 11/2000 | Iwata | 343/30 |
| 6,286,928 | B1 | * | 9/2001 | Kasamatsu | 347/23 |

FOREIGN PATENT DOCUMENTS

| | | | | |
|---|---|---|---|---|
| EP | 0704307 A2 | | 4/1996 | |
| JP | 0 671 274 A1 | | 9/1995 | |
| WO | WO 93/17867 | * | 9/1993 | 347/28 |

* cited by examiner

*Primary Examiner*—Shih-wen Hsieh
(74) *Attorney, Agent, or Firm*—Roth & Goldman

(57) ABSTRACT

A method of automatically servicing the orifices of an inkjet printhead particularly beneficial for inexpensive fixed or stationary printhead printers capable or printing onto either a series of discrete media sheets or onto a continuous media web. The method includes orifice servicing at the start of each character printing job and at periodic intervals during completion of print jobs. Printing ink is used for automatic cleaning or flushing of the printhead orifices.

10 Claims, No Drawings

PERIODIC EJECTION OF PRINTING FLUID TO SERVICE ORIFICES OF AN INKJET PRINTER

BACKGROUND OF THE INVENTION

The present invention relates to the art of inkjet printing and, more particularly, to a method of preventing the clogging of orifices without the necessity of automatic or manual wiping and capping thereof between print jobs.

As is well known in the art, inkjet printers include one or more printheads which eject ink through multiple orifices in an orifice plate to form the desired characters on the media on which printing takes place. The firing of the ink through the individual orifices of piezoelectric or thermal inkjet printheads is electrically controlled. Although the invention is primarily intended for use in fixed head printers, e.g. mail printers, the teachings of the invention are also applicable to other types of printers such as desk top printers and large format printer/plotters which use one or more printheads mounted on a movable carriage which traverses back and forth across the path of movement of the paper or other media on which printing is to take place. Typically, such high end printers employ automatic printhead servicing stations which include printhead wipers, caps, spittoons and other servicing components all located laterally of the media path to service the individual printheads and cap them from time to time between print jobs to prevent prolonged exposure of the printheads to the atmosphere with resultant drying of ink and clogging of the printhead orifices.

Current fixed head printers do not include separate printhead service stations due to the attendant cost and difficulties involved in accessing the printheads with servicing components. Print startup problems caused by clogging of the orifices of fixed head printers are thus very common. It is necessary for operators to remove the printheads for manual servicing such as cleaning of the orifice plates with water and cloth before starting a print job. This job is a comparatively dirty and undesirable one which is often postponed with resultant deterioration of the print quality. It is accordingly the primary objective of the present invention to provide a simple manner of automatically servicing the orifices of inkjet printheads without the necessity of manual intervention.

SUMMARY OF THE INVENTION

The present invention therefore provides a method of operating an inkjet printer comprising the steps of:

a) printing a desired pattern onto moving print media by ejecting printing fluid from a supply thereof in a desired pattern through orifices of an inkjet printhead;

b) terminating said printing onto said media;

c) periodically ejecting printing fluid from said supply through said orifices to periodically servicee said orifices until printing is to resume; and d) resuming said printing by ejecting printing fluid from said supply through said orifices in a desired pattern onto said moving print media.

DETAILED DESCRIPTION OF THE PREFERRED EMBODIMENT

The method of the present invention will first be described in connection with printing onto a movable series of discrete pieces of print media such as individually fed sheets which themselves may each include a plurality of individual labels or other areas onto which printing is to take place such, for example, as a series of detachable gummed labels. The method involves first moving the media sheets past the printhead or printheads while printing the desired pattern onto the moving print media by ejecting printing fluid from a supply thereof in a desired pattern through the orifices of one or more inkjet printheads. The inkjet printheads may be of the self contained refillable or replaceable type which contains its own supply of ink or one to which ink is continuously or periodically supplied from a remote ink reservoir or reservoirs. Printing is continued while one or more of a movable series of discrete media pieces is automatically moved through the printer proximate the inkjet printhead or printheads for a preselected period of time or until a known volume of ink has been dispensed as determined by drop counting or other methods following which the print job is temporarily interrupted or terminated. Preferably the printing is terminated after each of a series of media pieces has been completely printed, the last of such discrete pieces having been moved away, from the printheads.

Servicing of the orifices in the printhead or printheads is next performed by controlled ejection of a desired amount of printing fluid through the orifices by thermally or piezoelectrically firing the printheads to eject printing fluid through all of the orifices for a sufficient amount of time to cleanse the orifices. Preferably, movement of the movable series of discrete media pieces is terminated during periodic ejection of printing fluid through the orifices for servicing purposes between individual discrete pieces of media. If desired, fluid receptacles or spittoons may be located in the media path in alignment with the printheads so that the printing fluid ejected between the media pieces can be collected in the receptacle or receptacles provided. To minimize loss of printing fluid, the printing fluid collected in the receptacle can be filtered and recycled. Since the method has so far been described in connection with fixed head printers, it will be appreciated that the receptacle or receptacles must be located in alignment with the stationary printheads which are necessarily aligned with the path of travel of the media on which printing is to take place. When the method is used in conjunction with the servicing of printheads in movable carriage inkjet printers, it will be appreciated that the receptacles can be easily located laterally of the path of movement of the media on which printing is to take place.

In a fixed printhead printer in which printing takes place onto a movable series of discrete pieces of media, the periodic ejection of printing fluid through the orifices to periodically service the orifices may take place onto a sacrificial media piece instead of in between discrete media pieces. The sacrificial media piece may be a portion of a media piece on which non-sacrificial printing takes place in other areas or it may be an entirely separate sheet for receiving the periodically ejected printing fluid used for servicing purposes. The use of a sacrificial media piece does not entail termination of movement of the media during the orifice servicing.

The methods disclosed here also are applicable to printing onto a continuous media web rather than onto a series of individual sheets of media. When the method is used for printing onto a continuous web, movement of the web may be automatically terminated one or more times during the length of a print job for periodic orifice servicing in which the periodic ejection of printing fluid for servicing purposes is onto a stationary area of the web. In the alternative, movement of the web may continue at the same or at a speed other than the speed of movement of the web during character printing so that printing fluid ejected for servicing purposes is collected on the moving web.

Persons skilled in the current state of the art are well aware that various techniques and algorithms can be designed to determine the intervals and the amount of ink required for periodic orifice servicing purposes and the relationship of that amount to variable physical properties such as the viscosity and volatility of the ink, absorbency of the media on which printing takes place and the speed of movement thereof. If servicing ink is ejected onto sacrificial areas of moving media, the absorbency of the media and drying time of the ink may be used to control the speed of movement of the media to ensure adequate absorption or drying of the ink used for servicing before discharge of the media from the printer. Suitable programming of the circuitry for firing the printheads to insure that they are fired at the startup of each separate printing operation and periodically during the completion of long print jobs if desired is also well within the knowledge and skills of those skilled in the art of inkjet printing. The sensing of ambient temperature and. humidity conditions on a periodic or continuous basis with appropriate automatic adjustment of the intervals of time during which printhead orifice servicing is to take place is also contemplated. The methodology described is broadly applicable to inkjet printheads which employ pigment-based inks or dyes including colorless inks and other fluids such as underprinting fluid which may be used in advance of final character printing.

Persons skilled in the art will also appreciate that various additional modifications can be made in the preferred embodiment shown and described above and that the scope of protection is limited only by the wording of the claims which follow.

What is claimed is:

1. A method of operating an inkjet printer comprising the steps of:

a) printing a desired pattern onto a moving continuous web of print media by ejecting printing fluid onto said web from a supply thereof in a desired pattern through orifices of an inkjet printhead;

b) terminating said printing onto said media;

c) reducing the speed of movement of said web below a speed at which printing takes place;

d) then periodically ejecting printing fluid from said supply through said orifices onto said web to periodically service said orifices until printing is to resume;

e) returning the speed of movement of said web to the speed at which printing takes place; and f) resuming said printing by ejecting printing fluid from said supply through said orifices in a desired pattern onto said moving web of print media.

2. The method of claim 1, including maintaining said printhead in a single stationary position during said printing and said periodic ejection of fluid.

3. The method of claim 1, including the steps of terminating movement of said web, performing said periodic ejection of fluid onto a stationary area of said web, recommencing movement of said web and printing onto a moving area of said moving web.

4. The method of claim 3, including maintaining said printhead in a single stationary position during said printing and said periodic ejection of fluid.

5. The method of claim 1, wherein said periodic ejection of fluid is onto a moving portion of said web.

6. The method of claim 1, wherein said fluid is periodically ejected to service said orifices at equal intervals.

7. The method of claim 6, further comprising sensing ambient temperature and adjusting said intervals depending on said ambient temperature.

8. The method of claim 6, further comprising sensing ambient humidity and adjusting said intervals depending on said ambient humidity.

9. The method of claim 1, including keeping said printhead exposed to atmosphere during said periodic ejection of fluid.

10. The method of claim 9, wherein said printing fluid is ink.

* * * * *